US008984815B1

(12) United States Patent
LaFour et al.

(10) Patent No.: US 8,984,815 B1
(45) Date of Patent: Mar. 24, 2015

(54) AESTHETICALLY PLEASING AND CAMOUFLAGED ROOF TARP AND ASSOCIATED USE THEREOF

(71) Applicants: Preston LaFour, Saratoga, TX (US); Melissa LaFour, Saratoga, TX (US)

(72) Inventors: Preston LaFour, Saratoga, TX (US); Melissa LaFour, Saratoga, TX (US)

( * ) Notice: Subject to any disclaimer, the term of this patent is extended or adjusted under 35 U.S.C. 154(b) by 0 days.

(21) Appl. No.: 14/071,835

(22) Filed: Nov. 5, 2013

(51) Int. Cl.
*E04G 21/28* (2006.01)
*E04D 13/00* (2006.01)

(52) U.S. Cl.
CPC ..... *E04G 21/28* (2013.01)
USPC ..... 52/3; 52/506.04; 52/202

(58) Field of Classification Search
CPC ..... E04G 21/28; E04D 12/002; E04D 13/00; E04D 5/08
USPC ..... 52/656.1–656.3, 745.15–745.16, 52/199–200, 208, 202, 506.04, 507, 213, 52/19, 3, DIG. 13–DIG. 14, DIG. 16, 23, 52/DIG. 12
See application file for complete search history.

(56) References Cited

U.S. PATENT DOCUMENTS

| | | | | | |
|---|---|---|---|---|---|
| 4,610,116 | A | * | 9/1986 | Schulz | 52/200 |
| 4,614,067 | A | * | 9/1986 | Matsubara | 52/235 |
| 4,663,905 | A | * | 5/1987 | Schulz | 52/202 |
| RE33,720 | E | * | 10/1991 | Cummings | 52/200 |
| 5,343,668 | A | * | 9/1994 | Gonzalez | 52/712 |
| 5,347,768 | A | * | 9/1994 | Pineda | 52/23 |
| 5,715,636 | A | * | 2/1998 | Taylor | 52/308 |
| 7,650,723 | B1 | * | 1/2010 | Kotlarich | 52/202 |

FOREIGN PATENT DOCUMENTS

GB 2439082 A * 12/2007

* cited by examiner

*Primary Examiner* — Jeanette E Chapman

(57) ABSTRACT

A roof tarp system includes a roof surface located at the roof of an existing structure. Such a roof surface includes an inner layer and an outer layer spaced therefrom, wherein the outer layer has a plurality of first roof tiles. The roof surface further includes a continuous opening passes through the inner layer and the outer layer such that an uninhibited line of sight passes through the roof surface. A tarp is removably engaged with the roof surface in such a manner that the tarp completely covers the opening and becomes camouflaged with the outer layer. Such a tarp includes a body having a plurality of second roof tiles identical to the first roof tiles such that the tarp is camouflaged when positioned over the opening and onto the roof surface. In this manner, the outer layer is coplanar with the body of the tarp.

9 Claims, 4 Drawing Sheets

AESTHETICALLY PLEASING AND CAMOUFLAGED ROOF TARP AND ASSOCIATED USE THEREOF

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to roof tarps and, more particularly, to a line of tarp roof coverings adorned with actual roofing designs, such as shingles and metal panels. The intent is to provide a more aesthetically pleasing alternative to blue tarps when it is necessary to attend to roofing repairs.

2. Prior Art

Hurricanes, tornadoes and freak winds often wreak havoc on roofing, particularly those in residential communities. The aftermath of these devastating natural disasters is usually a sea of blue tarpaulins covering the damaged roofing while the homeowners await insurance settlements and permanent repairs. These "sea" of blue (or other color) tarps are visually unsightly and create a negative aura about a community. This negative can have a serious psychological impact on residents and generally downgrade the inherent value of property in and around the "sea" of ugly tarps.

There is thus a need for a substitute for these "ugly" tarps which can both protect a damaged roof as well as provide a more aesthetically pleasing appearance to the roof before it is re-shingled or retiled.

Aside from emergencies, roofs regularly need to be repaired and replaced. An initial step in replacing a roof is removal of existing shingles, shakes or tiles plus the waterproof underlayment. The latter is typically "felt paper" which is a rolled sheet material impregnated with a bituminous substance. Such material by itself will typically only provide moisture protection to the underlying building structure for a few weeks. Thus, there is a need for a longer lasting waterproof underlayment that can protect structures for longer periods of time.

In addition, underlayments such as "felt paper" are very heavy, typically 0.176 lb/sq. ft. This weight limits the roll size of such underlayments to about 225-250 square feet when unrolled. Thus, there is a need for a lightweight, durable underlayment that can be supplied in larger roll sizes that cover more roof area per roll and is easier to lift and unroll than "felt paper" and similar underlayment.

Whatever the circumstance, hurricane or periodic roof replacement, it is desirable that an underlayment be available to a roofer that is less unsightly than the typical "tarp" or felt paper, yet is durable enough to remain in place for extended periods before permanent roofing (shingles, tiles, etc.) can be installed.

Accordingly, a need remains for a line of tarp roof coverings adorned with actual roofing designs in order to overcome prior art shortcomings. The exemplary embodiment(s) satisfy such a need by providing a line of tarp roof coverings adorned with actual roofing designs, such as shingles and metal panels that are convenient and easy to use, lightweight yet durable in design, versatile in its applications, and designed for providing a more aesthetically pleasing alternative to blue tarps when it is necessary to attend to roofing repairs.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a roof tarp system for covering a damaged portion of a roof. These and other objects, features, and advantages of the non-limiting exemplary embodiment(s) are provided by a roof tarp system including a roof surface located at the roof of an existing structure. Such a roof surface includes an inner layer and an outer layer spaced therefrom, wherein the outer layer has a plurality of first roof tiles. The roof surface further includes a continuous opening passes through the inner layer and the outer layer such that an uninhibited line of sight passes through the roof surface. The roof surface further includes a plurality of roof surface supports intercalated between the inner layer and the outer layer. The system further includes a tarp removably engaged with the roof surface in such a manner that the tarp completely covers the opening and becomes camouflaged with the outer layer. Such a tarp includes a body having a plurality of second roof tiles identical to the first roof tiles such that the tarp is camouflaged when positioned over the opening and onto the roof surface. In this manner, the outer layer is coplanar with the body of the tarp.

In a non-limiting exemplary embodiment, the tarp further includes a transparent layer spanning over an entire area of the opening and engaged with the inner layer of the roof surface such that the transparent layer is spaced subjacent to the outer layer of the roof surface.

In a non-limiting exemplary embodiment, the tarp further includes a plurality of first roof tarp supports intercalated between the body and the transparent layer.

In a non-limiting exemplary embodiment, the tarp further includes a plurality of second roof tarp supports intercalated between the outer layer of the roof surface and the inner layer of the roof surface.

In a non-limiting exemplary embodiment, the second roof tarp supports are engaged with the transparent layer of the tarp and disposed adjacent to the roof surface supports.

In a non-limiting exemplary embodiment, the body of the tarp contiguously lays parallel to the outer layer of the roof surface.

In a non-limiting exemplary embodiment, the first roof tiles and the second roof tiles are coextensively shaped.

In a non-limiting exemplary embodiment, each of the first roof tiles and the second roof tiles are roof shingles.

The disclosure further includes a method of utilizing a roof tarp system for covering a damaged portion of a roof. Such a method includes the initial step of: accessing a roof surface located at the roof of an existing structure wherein the roof surface includes an inner layer and an outer layer spaced therefrom. The outer layer has a plurality of first roof tiles. The roof surface further includes a continuous opening passes through the inner layer and the outer layer such that an uninhibited line of sight passes through the roof surface, and a plurality of roof surface supports intercalated between the inner layer and the outer layer. The method further includes the step of obtaining and removably engaging a tarp with the roof surface in such a manner that the tarp completely covers the opening and becomes camouflaged with the outer layer. Such a tarp includes a body having a plurality of second roof tiles identical to the first roof tiles such that the tarp is camouflaged when positioned over the opening and onto the roof surface. In this manner, the outer layer is coplanar with the body of the tarp.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
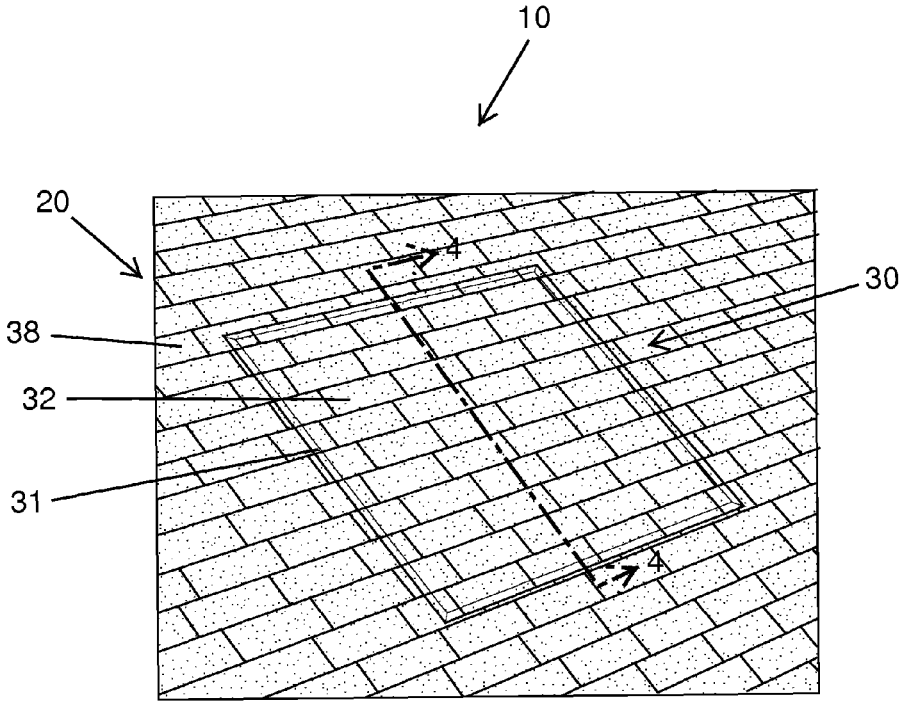
FIG. 1 is a perspective view of a roof tarp system, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Figure 2:
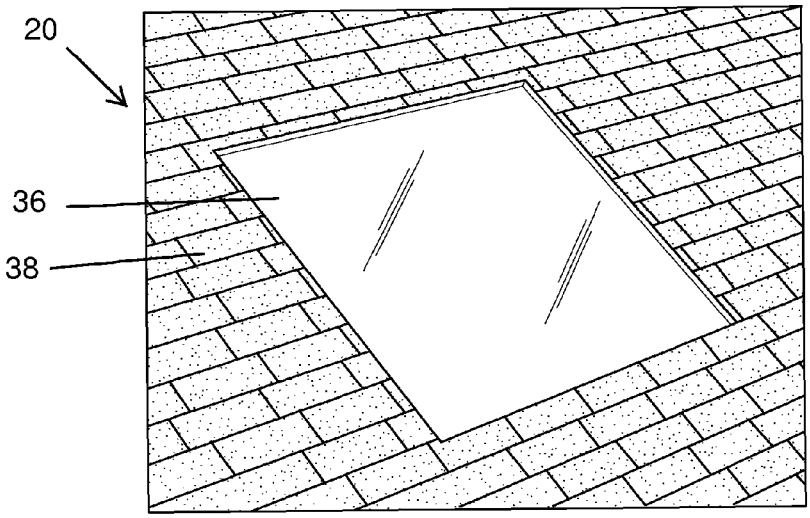
FIG. 2 is a perspective view showing the roof tarp system when the body of the tarp is removed thereby exposing a transparent layer.
Figure 3:
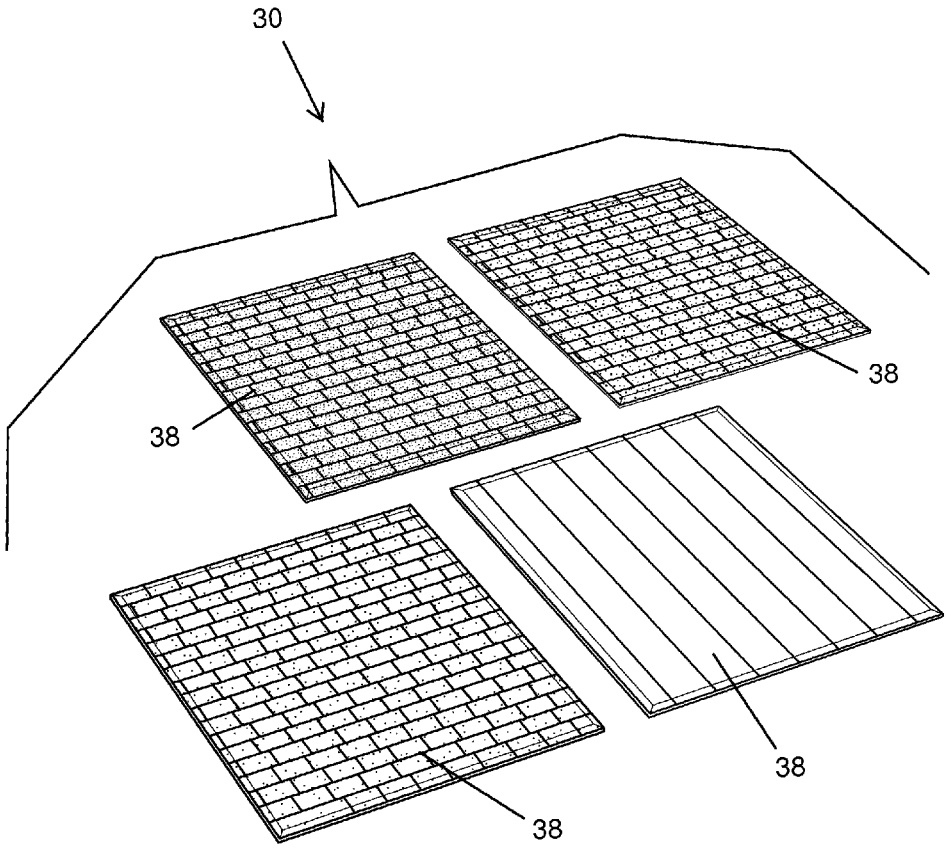
FIG. 3 are perspective views showing exemplary roof tiles positioned on the outer surface of the body.
Figure 4:
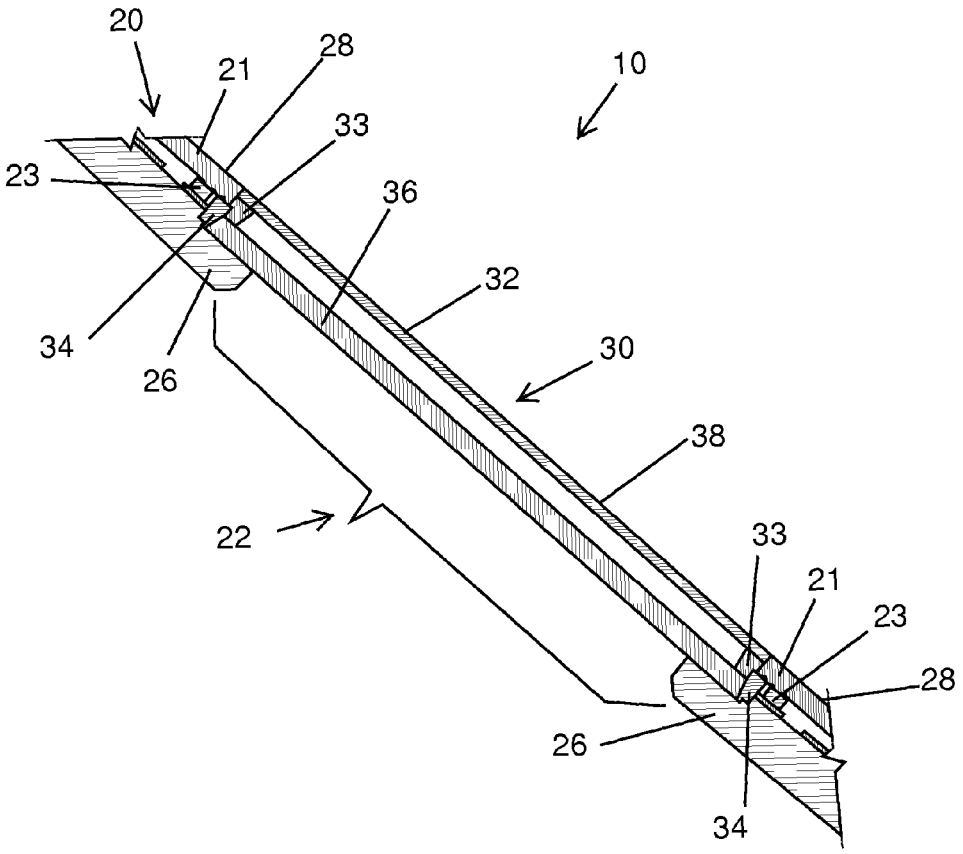
FIG. 4 is an enlarged cross-sectional view taken along line 4-4 in FIG. 1.

The non-limiting exemplary embodiment(s) is/are referred to generally in FIGS. 1-4 and is/are intended to provide a roof tarp system 10 for covering and camouflaging a damaged portion of a roof. A non-limiting exemplary embodiment of the present disclosure is referred to generally in the figures and is intended to provide a line of tarp roof covering systems 10 adorned with actual roofing designs. It should be understood that the exemplary embodiment may be used to cover many different types of roofs, and should not be limited to any particular roof design described herein.

Referring to FIGS. 1-4, a roof tarp system 10 including a roof surface 20 located at the roof of an existing structure. Such a roof surface 20 includes an inner layer 26 and an outer layer 21 spaced therefrom, wherein the outer layer 21 has a plurality of first roof tiles 28. The roof surface 20 further includes a continuous opening 22 passing through the inner layer 26 and the outer layer 21 such that an uninhibited line of sight passes through the roof surface 20, when the tarp 30 is not positioned over the opening 22. The roof surface 20 further includes a plurality of roof surface supports 23 intercalated between the inner layer 26 and the outer layer 21. The system 10 further includes a tarp 30 removably engaged with the roof surface 20 in such a manner that the tarp 30 completely covers the opening 22 and becomes camouflaged with the outer layer 21. Such a tarp 30 includes a body 32 having a plurality of second roof tiles 38 identical to the first roof tiles 28 such that the tarp 30 is camouflaged when positioned over the opening 22 and onto the roof surface 20. In this manner, the outer layer 21 is coplanar with the body 32 of the tarp 30.

In a non-limiting exemplary embodiment, the tarp 30 further includes a transparent layer 36 spanning over an entire area of the opening 22 and engaged with the inner layer 26 of the roof surface 20 such that the transparent layer 36 is spaced subjacent to the outer layer 21 of the roof surface 20. Such a transparent layer may be glass or plastic, for example.

In a non-limiting exemplary embodiment, the tarp 30 further includes a plurality of first roof tarp supports 33 intercalated between the body 32 and the transparent layer 36.

In a non-limiting exemplary embodiment, the tarp 30 further includes a plurality of second roof tarp supports 34 intercalated between the outer layer 21 of the roof surface 20 and the inner layer 26 of the roof surface 20.

In a non-limiting exemplary embodiment, the second roof tarp supports 34 are engaged with the transparent layer 36 of the tarp 30 and disposed adjacent to the roof surface supports 23.

In a non-limiting exemplary embodiment, the body 32 of the tarp 30 contiguously lays parallel to the outer layer 21 of the roof surface 20.

In a non-limiting exemplary embodiment, the first roof tiles 28 and the second roof tiles 38 are coextensively shaped.

In a non-limiting exemplary embodiment, each of the first roof tiles 28 and the second roof tiles 38 are roof shingles.

The disclosure further includes a method of utilizing a roof tarp system 10 for covering a damaged portion of a roof. Such a method includes the initial step of: accessing a roof surface 20 located at the roof of an existing structure wherein the roof surface 20 includes an inner layer 26 and an outer layer 21 spaced therefrom. The outer layer 21 has a plurality of first roof tiles 28. The roof surface 20 further includes a continuous opening 22 passing through the inner layer 26 and the outer layer 21 such that an uninhibited line of sight passes through the roof surface 20, and a plurality of roof surface supports 23 intercalated between the inner layer 26 and the outer layer 21. The method further includes the step of obtaining and removably engaging a tarp 30 with the roof surface 20 in such a manner that the tarp 30 completely covers the opening 22 and becomes camouflaged with the outer layer 21. Such a tarp 30 includes a body 32 having a plurality of second roof tiles 38 identical to the first roof tiles 28 such that the tarp 30 is camouflaged when positioned over the opening 22 and onto the roof surface 20. In this manner, the outer layer 21 is coplanar with the body 32 of the tarp 30.

In a non-limiting exemplary embodiment, a line of tarpaulins (tarps) is decorated in the same manner of the roof that they are covering. In other words, these tarps appear more realistic than the blue-tarp-eyesores that are commonly used for this purpose. Rectangular sheets of canvas material, the customized tarp may include a large sheet of strong, flexible, water-resistant or waterproof material with reinforced grommets at the corners and along the sides to form attachment points for rope, which allow the tarps to be tied down.

In a non-limiting exemplary embodiment, each tarp 30 may be treated against damage from the sun's ultraviolet rays so that the tarps are able to remain strong for extended periods of time. The display side of each sheet features a mirror image of a common roof covering. Examples include shingles, or individual, overlapping rectangular elements found on many roofs; and shiny, ornate metal panels with elongated, beveled slats to match the roof they are protecting.

Should a homeowner experience damage to the roof from a hurricane or other storm mishap, sheets of the roof tarp could easily be secured over the marred sections, blending seamlessly with the undamaged portions of the roof. After the roof has been repaired, the units can be folded and stored away until needed again.

There are several significant benefits and advantages associated with this clever product invention. For example, the roof tarp would provide homeowners with a more visually appealing line of protection when roof repairs are necessary. Eliminating the need to rely on the ubiquitous blue tarp to serve this purpose, these realistic coverings lend even the most damaged of roofs a more elegant appearance. Allowing users to match the existing design of their own house-topper, the roof tarp would cleverly disguise any damage. Those viewing the roof from a distance would likely not be able to tell that the roof is even undergoing repairs.

With this product in place, homeowners need not have their homes draped in a depressing reminder of storms and other damage-causing occurrences. Available in a variety of sizes and designs, each roof tarp matches virtually any home's specific needs. While ideal for consumers to use on their houses, professional roofers and construction professionals would certainly benefit from offering such a convenient product to their clients. Fabricated of durable, high quality materials and components, the roof tarp withstands years of continued use.

A non-limiting exemplary embodiment of the present disclosure is referred to generally in the figures and is intended to provide a line of tarp roof coverings adorned with actual roofing designs. It should be understood that the exemplary embodiment may be used to cover many different types of roofs, and should not be limited to any particular roof design described herein.

Referring to the figures in general, in a non-limiting exemplary embodiment, a line of tarpaulins (tarps) is decorated in the same manner of the roof that they are covering. In other words, these tarps appear more realistic than the blue-tarp-eyesores that are commonly used for this purpose. Rectangular sheets of canvas material, the customized tarp may include a large sheet of strong, flexible, water-resistant or waterproof material with reinforced grommets at the corners and along the sides to form attachment points for rope, which allow the tarps to be tied down.

In a non-limiting exemplary embodiment, each sheet may be treated against damage from the sun's ultraviolet rays so that the tarps are able to remain strong for extended periods of time. The display side of each sheet features a mirror image of a common roof covering. Examples include shingles, or individual, overlapping rectangular elements found on many roofs; and shiny, ornate metal panels with elongated, beveled slats to match the roof they are protecting.

Should a homeowner experience damage to the roof from a hurricane or other storm mishap, sheets of the roof tarp could easily be secured over the marred sections, blending seamlessly with the undamaged portions of the roof. After the roof has been repaired, the units can be folded and stored away until needed again.

There are several significant benefits and advantages associated with this clever product invention. For example, the roof tarp would provide homeowners with a more visually appealing line of protection when roof repairs are necessary. Eliminating the need to rely on the ubiquitous blue tarp to serve this purpose, these realistic coverings lend even the most damaged of roofs a more elegant appearance. Allowing users to match the existing design of their own house-topper, the roof tarp would cleverly disguise any damage. Those viewing the roof from a distance would likely not be able to tell that the roof is even undergoing repairs.

With this product in place, homeowners need not have their homes draped in a depressing reminder of storms and other damage-causing occurrences. Available in a variety of sizes and designs, each roof tarp matches virtually any home's specific needs. While ideal for consumers to use on their houses, professional roofers and construction professionals would certainly benefit from offering such a convenient product to their clients. Fabricated of durable, high quality materials and components, the roof tarp withstands years of continued use.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A roof tarp system for covering a damaged portion of a roof, said roof tarp system comprising:

a roof surface located at the roof of an existing structure, said roof surface including an inner layer and an outer layer spaced therefrom, said outer layer having a plurality of first roof tiles, an opening passing through said inner layer and said outer layer such that an uninhibited line of sight passes through said roof surface, and a plurality of roof surface supports intercalated between said inner layer and said outer layer; and a tarp removably engaged with said roof surface in such a manner that said tarp completely covers said opening and becomes camouflaged with said outer layer, said tarp including a body having a plurality of second roof tiles identical to said first roof tiles such that said tarp is camouflaged when positioned over said opening and onto said roof surface;

wherein said tarp further includes a transparent layer spanning over an entire area of said opening and engaged with said inner layer of said roof surface such that said transparent layer is spaced subjacent to said outer layer of said roof surface;

wherein said tarp further includes a plurality of first roof tarp supports intercalated between said body and said transparent layer;

wherein said tarp further includes a plurality of second roof tarp supports intercalated between said outer layer of said roof surface and said inner layer of said roof surface;

wherein said second roof tarp supports are engaged with said transparent layer of said tarp and disposed adjacent to said roof surface supports.

2. The roof tarp system of claim 1, wherein said body of said tarp contiguously lays parallel to said outer layer of said roof surface.

3. The roof tarp system of claim 1, wherein said first roof tiles and said second roof tiles are coextensively shaped.

4. The roof tarp system of claim 1, wherein said first roof tiles and said second roof tiles are roof shingles.

5. A roof tarp system for covering a damaged portion of a roof, said roof tarp system comprising:

a roof surface located at the roof of an existing structure, said roof surface including an inner layer and an outer layer spaced therefrom, said outer layer having a plurality of first roof tiles, a continuous opening passing through said inner layer and said outer layer such that an uninhibited line of sight passes through said roof surface, and a plurality of roof surface supports intercalated between said inner layer and said outer layer; and a tarp removably engaged with said roof surface in such a manner that said tarp completely covers said opening and becomes camouflaged with said outer layer, said tarp including a body having a plurality of second roof tiles identical to said first roof tiles such that said tarp is camouflaged when positioned over said opening and onto said roof surface;

wherein said outer layer is coplanar with said body of said tarp;

wherein said tarp further includes a transparent layer spanning over an entire area of said opening and engaged with said inner layer of said roof surface such that said transparent layer is spaced subjacent to said outer layer of said roof surface;

wherein said tarp further includes a plurality of first roof tarp supports intercalated between said body and said transparent layer;

wherein said tarp further includes a plurality of second roof tarp supports intercalated between said outer layer of said roof surface and said inner layer of said roof surface;

wherein said second roof tarp supports are engaged with said transparent layer of said tarp and disposed adjacent to said roof surface supports.

6. The roof tarp system of claim 5, wherein said body of said tarp contiguously lays parallel to said outer layer of said roof surface.

7. The roof tarp system of claim 5, wherein said first roof tiles and said second roof tiles are coextensively shaped.

8. The roof tarp system of claim 5, wherein said first roof tiles and said second roof tiles are roof shingles.

9. A method of utilizing a roof tarp system for covering a damaged portion of a roof, said method comprising the steps of:

accessing a roof surface located at the roof of an existing structure, said roof surface including an inner layer and an outer layer spaced therefrom, said outer layer having a plurality of first roof tiles, a continuous opening passing through said inner layer and said outer layer such that an uninhibited line of sight passes through said roof surface, and a plurality of roof surface supports intercalated between said inner layer and said outer layer; and obtaining and removably engaging a tarp with said roof surface in such a manner that said tarp completely covers said opening and becomes camouflaged with said outer layer, said tarp including a body having a plurality of second roof tiles identical to said first roof tiles such that said tarp is camouflaged when positioned over said opening and onto said roof surface, wherein said outer layer is coplanar with said body of said tarp;

wherein said tarp further includes a transparent layer spanning over an entire area of said opening and engaged with said inner layer of said roof surface such that said transparent layer is spaced subjacent to said outer layer of said roof surface;

wherein said tarp further includes a plurality of first roof tarp supports intercalated between said body and said transparent layer;

wherein said tarp further includes a plurality of second roof tarp supports intercalated between said outer layer of said roof surface and said inner layer of said roof surface;

wherein said second roof tarp supports are engaged with said transparent layer of said tarp and disposed adjacent to said roof surface supports.

* * * * *